US005816953A

United States Patent [19]

Cleveland

[11] Patent Number: 5,816,953

[45] Date of Patent: Oct. 6, 1998

[54] METHOD AND APPARATUS FOR INTERACTIVE TENNIS PRACTICE

[76] Inventor: William C. Cleveland, 62 Lenwood Blvd., Charleston, S.C. 29401

[21] Appl. No.: 674,762

[22] Filed: Jul. 2, 1996

[51] Int. Cl.[6] ..... A63B 69/38; A63F 9/24

[52] U.S. Cl. ..... 473/459; 473/422; 463/3

[58] Field of Search ..... 473/459, 462, 473/451, 421, 467, 468, 469, 473, 474, 475; 463/2, 3, 4; 364/410, 411

[56] References Cited

U.S. PATENT DOCUMENTS

| | | |
|---|---|---|
| 2,005,241 | 6/1935 | Robinson . |
| 3,415,517 | 12/1968 | Krist . |
| 3,989,245 | 11/1976 | Augustine, Jr. et al. . |
| 3,989,246 | 11/1976 | Brown et al. . |
| 4,070,018 | 1/1978 | Hodges . |
| 4,269,163 | 5/1981 | Feith . |
| 4,309,032 | 1/1982 | Facius . |
| 4,514,621 | 4/1985 | Knight et al. . |
| 4,885,725 | 12/1989 | McCarthy et al. . |
| 4,898,388 | 2/1990 | Beard, III et al. . |
| 4,915,384 | 4/1990 | Bear . |
| 5,056,068 | 10/1991 | Barnes . |
| 5,062,641 | 11/1991 | Poillon et al. . |
| 5,265,875 | 11/1993 | Fitzgerald . |
| 5,303,924 | 4/1994 | Kluttz et al. . |
| 5,342,051 | 8/1994 | Rankin et al. . |
| 5,393,064 | 2/1995 | Beard, III et al. . |
| 5,398,936 | 3/1995 | Kluttz et al. . |
| 5,566,936 | 10/1996 | Newgarden et al. ..... 473/462 X |

*Primary Examiner*—Jessica Harrison
*Assistant Examiner*—Michael O'Neill
*Attorney, Agent, or Firm*—Kennedy, Covington, Lobdell, & Hickman, LLP

[57] ABSTRACT

A device and method for interactive tennis practice to improve a player's skills and sense and record the player's performance. One of a number of predetermined practice drill patterns are selected, a ball machine is controlled to project tennis balls onto a tennis court in the selected practice drill pattern, and the points of impact of the tennis balls after they have been struck by a player are sensed and displayed on a video screen. The player may select one of several predetermined target areas on the court for display on the video screen, and the sensed points of impact may be recorded for later retrieval. The ball machine may project tennis balls in timed response to the sensing of the impacts of balls struck by the player. Game play may be simulated by selecting one of a number of predetermined target areas on the tennis court, projecting a tennis ball to be struck by the player onto the court, sensing the impact of the tennis ball in the target area after it has been struck, controlling the ball machine to project another ball in timed response to the sensed impact, and projecting another ball each time an impact in the target area is sensed.

31 Claims, 10 Drawing Sheets

METHOD AND APPARATUS FOR INTERACTIVE TENNIS PRACTICE

The present invention relates generally to devices for interactive tennis practice, and more particularly to a tennis practice device which offers a player a choice of a variety of drills and accurately senses and records the performance of the player in each drill chosen.

Tennis players practicing with a conventional ball machine or with a partner often find it difficult to accurately evaluate their performance in specific areas, such as backhand cross-court shots, low backhand volleys, etc. It is, however, very useful for a player to pinpoint the particular strokes which are most troublesome for him or her, so that practice can be tailored to those areas. A player may also find it difficult, in practice sessions and in game play, to accurately evaluate his or her progress and improvement in specific areas over a period of time. Accurate evaluation of progress can be very helpful in efficiently developing tennis skills, since successful practice techniques can thereby be identified and pursued further, and unsuccessful techniques can be discontinued. Players who are practicing alone, either with a conventional ball machine or against a rebound backboard, also face a difficulty in that the important experience of having an opponent return shots responsively, as in a game, is not available to them.

Attempts have been made to develop practice devices which are more effective in improving tennis skills. Robinson U.S. Pat. No. 2,005,241 discloses a vertical rebound backboard and horizontal foreground which are both marked in an attempt to indicate how a shot directed against the backboard would land on an actual tennis court. However, the markings on the backboard and foreground can only vaguely indicate how a shot would actually fall, in that different shots can pass through the same point on the vertical plane of the backboard yet have dramatically different impact points on an actual court due to having a different trajectory and velocity, and, moreover, the true lateral direction of the shot will be interrupted by the backboard and altered on the rebound. A ball rebounding off of the backboard may be returned by a player on the rebound, but such rebounds do not accurately simulate the timing, variability of spin, speed and direction, nor location, of a shot hit by an opposing player.

Augustine, Jr. et al. U.S. Pat. No. 3,989,245 discloses a tennis practice device consisting of a ball-projecting machine and a simulated tennis court with a target area. However, the target area is located on an inclined backstop, and does not realistically inform the player of how his shots would land on an actual tennis court. A practicing player therefore does not receive accurate feedback regarding the accuracy and true impact location of his or her shots. Brown et al. U.S. Pat. No. 3,989,246 discloses a ball impact target area consisting of a flexible damping screen in vertical orientation which is marked with target areas, and which incorporates ball impact sensors. This device is essentially a variation of the marked backboard, and also cannot accurately indicate the landing point of a tennis shot, although it does incorporate mechanical sensors which have some limited ability to sense the velocity of a shot. Facius U.S. Pat. No. 4,309,032 discloses a rebound backboard marked to provide target areas, with detection apparatus to indicate when the targets are struck. This device also suffers from the inherent limitations of a rebound backboard.

Hodges U.S. Pat. No. 4,070,018 discloses a ball impact target consisting of a flexible damping screen in vertical orientation which is marked with target areas, and which incorporates ball impact sensors. This device is essentially another variation of the marked backboard, and also cannot accurately indicate the landing point of a tennis shot, although it does incorporate weighted mechanical sensors which have some limited ability to sense the velocity of a shot. However, the effects of side spin and sharply angled shots on impact location are not accurately sensed. Feith U.S. Pat. No. 4,269,163 discloses a game ball delivery device which can be programmed to project balls to selected locations on a tennis court at selected intervals, but the device does not sense the impact location of the practicing player's return shots. Krist U.S. Pat. No. 3,415,517 discloses an impact indicator system for tennis which employs transducers to sense the shock of the impact of a tennis ball. However, Krist requires a complex arrangement of transducers to cover a tennis court and cannot indicate the exact impact of a tennis ball, but only whether the ball has landed within certain areas covered by certain groups of transducers (boundary lines or defined areas such as service courts).

Beard III et al. U.S. Pat. No. 4,898,388 discloses a device which determines the impact point of a golf ball using the sound of the impact, which is sensed by an array of sensors and calculated by a triangulation process, and data regarding the golf ball impacts can be stored and later analyzed. The Beard III device is passive, however, in that it is not incorporated in the game play involved, but merely senses results. Such an arrangement is not capable of simulating tennis game play.

The game simulation devices previously disclosed therefore lack several features important to an effective tennis practice device. Accurate sensing of the impact location of a tennis ball has not previously been incorporated with a ball machine to provide a variety of drills in an arrangement where the practicing player's performance can be accurately detected and recorded for review, and applicants are aware of no prior realistic simulation of game play in which a ball machine operates in timed response to a player's shots.

SUMMARY OF THE INVENTION

In accordance with the present invention, a device and method are provided for interactive tennis practice to improve a tennis player's skills and sense and record the player's performance. The present invention comprises a ball machine for projecting tennis balls onto a tennis court, a control device for controlling the ball machine to project tennis balls in a plurality of predetermined practice drill patterns which can be selectively chosen by a tennis player who wishes to practice, and a sensing device for sensing the point of impact on the tennis court of each tennis ball after it has been struck by the player. It is advantageous if the sensing device includes sensors for detecting the point of impact of each ball which impacts the net of the tennis court.

It is also advantageous if the sensing device can record the point of impact of each ball after it has been struck by the player and retrieve the records of the points of impact. In accordance with another aspect of the invention, a player can selectively adjust and alter the velocity, trajectory, and direction of the tennis balls projected by the ball machine during a particular drill as the player desires.

In accordance with a further aspect of the invention, a player may select one of a plurality of predetermined target areas on the tennis court, and cause the selected target area to be displayed on the video screen of the device of the present invention. The device may generate a predetermined audible signal when the player successfully hits a tennis ball into the target area selected by the player, thereby informing the player that he or she has hit the target. The device may also record the number impacts within the target area which the player achieves consecutively, determine when the player reaches a new high for consecutive impacts in the target area, and generate a predetermined audible signal in response. The device may determine if the player breaks his or her record of consecutive impacts in the target area successively and generate increasingly louder predetermined audible signals each time the player successively reaches a new high.

In accordance with a further aspect, the present invention comprises a ball machine for projecting onto a tennis court a plurality of tennis balls in series to be struck by a player, a sensing device for sensing the impacts on said tennis court of such tennis balls after they have been struck by the player and transmitting a signal each time an impact is sensed, and a control device for controlling the ball machine to project a tennis ball in timed response to the receipt of a signal transmitted by the sensing device.

In accordance with another aspect, the present invention provides a simulation of game play and comprises a ball machine for projecting onto a tennis court a plurality of tennis balls in series to be struck by a player, target means for permitting the player to select one of a plurality of predetermined target areas within the confines of the tennis court, a sensing device for sensing the impacts within said target area of such tennis balls after they have been struck by the player and transmitting a signal each time an impact is sensed, and a control device for controlling the ball machine to project another of the tennis ball in timed response to the receipt of a signal transmitted by the sensing device.

The present invention may provide a player with a selection of predetermined shot profiles for the ball machine, the profiles having preset characteristics of velocity, trajectory, and direction to control the manner in which the ball machines projects tennis balls. The sensing device of the interactive tennis practice device of the present invention may permit a player to set a win-level by selecting a number of impacts within the target area which a player can achieve to cause the ball machine to cease projecting balls toward the player.

In accordance with an aspect of the method of the present invention, the method comprises projecting onto a tennis court with a ball machine one of a plurality of tennis balls to be struck by a player, sensing the initial impact of the tennis ball after it has been been struck by the player, transmitting a signal each time an impact has been sensed, receiving the signal and controlling the ball machine to project another of the plurality of tennis balls toward the player in timed response to the receipt of the signal, and repeating the steps of sensing the point of impact, transmitting the signal, receiving the signal and controlling the ball machine to project another ball each time one of the tennis balls impacts on the tennis court after being struck by the player.

In accordance with a further aspect of the method of the present invention, the method simulates game play and comprises selecting one of a plurality of predetermined target areas, projecting onto a tennis court with a ball machine one of a plurality of balls to be struck by a player, sensing the impact of the tennis ball in the target area after it has been struck by the player and transmitting a signal, receiving the signal and controlling the ball machine to project another of the tennis balls, and repeating the steps of sensing the point of impact, transmitting the signal, receiving the signal and controlling the ball machine to project another ball each time one of the tennis balls impacts in the target area after being struck by the player.

Accordingly, the present invention provides a device and method for interactively practicing and improving tennis skills which gives a player an accurate record of progress and performance, while incorporating target selection, responsive delivery of shots from a ball machine, and audible feedback of results during the practice session. Moreover, the invention provides a realistic, instructional, and entertaining simulation of game play.

DETAILED DESCRIPTION OF THE PREFERRED EMBODIMENT

Figure 1:
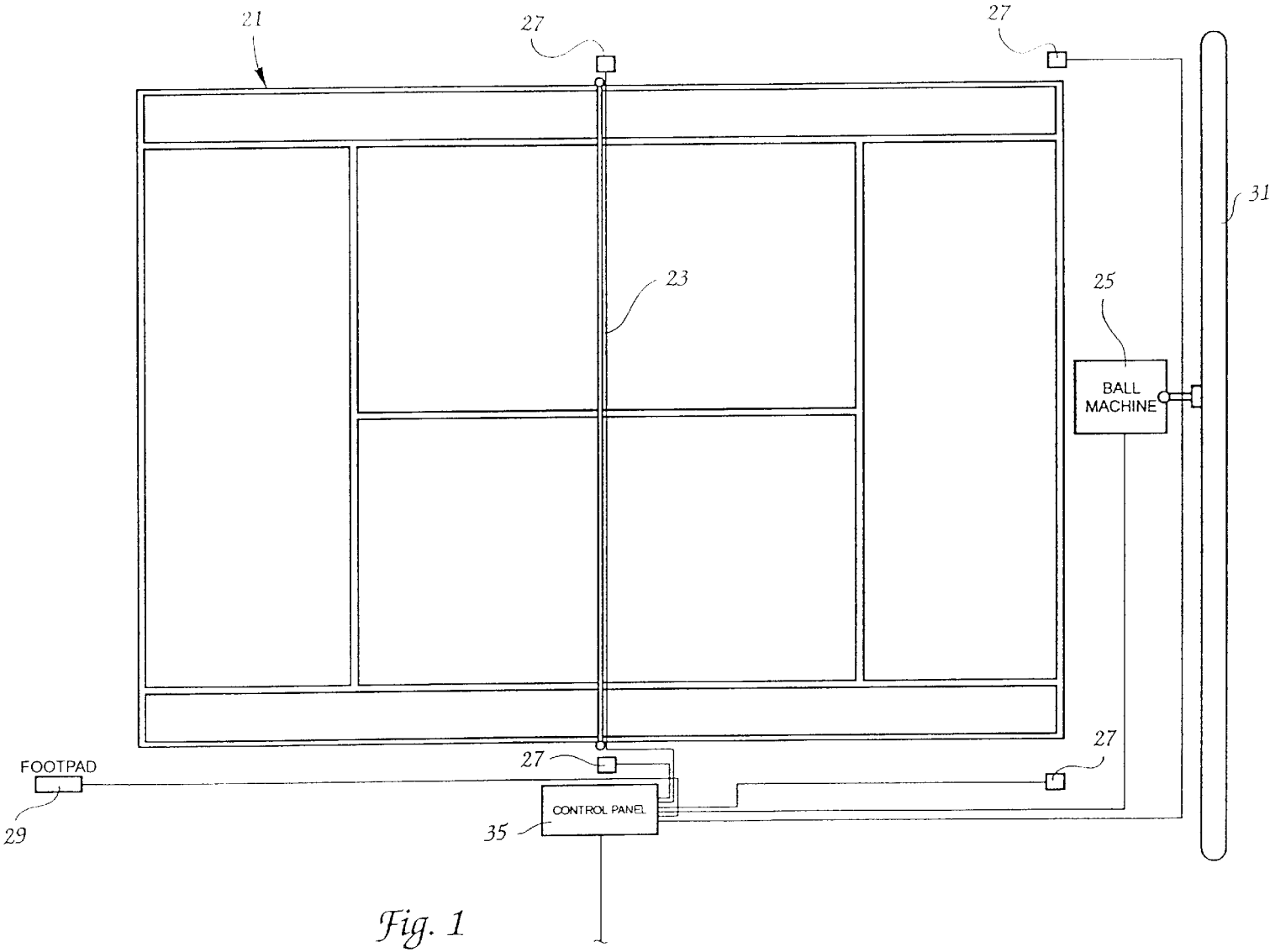
FIG. 1 is a diagram of a tennis court showing components of a device embodying the present invention and their preferred placement on the court.

Looking now in greater detail at the accompanying drawings, FIG. 1 is a diagram of a tennis court 21 with the components of the device of the present invention in place, ready for operation. The tennis court is outlined by the traditional sidelines, baselines, and service court markings, and has a net 23 dividing the court 21. A generally conventional ball machine 25 stands at one end of court 21, positioned to project balls to a player (not shown) standing at the other end of court 21. There are a number of conventional ball machines available on the market, such as a Metal Tek ball machine, which can be used with the present invention when modified so that the controls for the machine can be actuated by a computer 33 located in control panel 35 near net 23. Four microphones 27 are located on pedestals positioned adjacent the court, and are linked by cables to control panel 35.

A footpad control 29, the details of which are not part of the present invention, is positioned near the player's end of court 21, and has a stop pad (not shown), which a player can press to stop a practice drill which is underway, a start pad (not shown), which the player can press to start a drill, and a replay pad (not shown), which a player can press to restart a drill from the beginning. A conventional Cortland ball retrieval system 31, which is not part of the present invention, collects balls hit by the player and feeds them back to ball machine 25.

Figure 2:
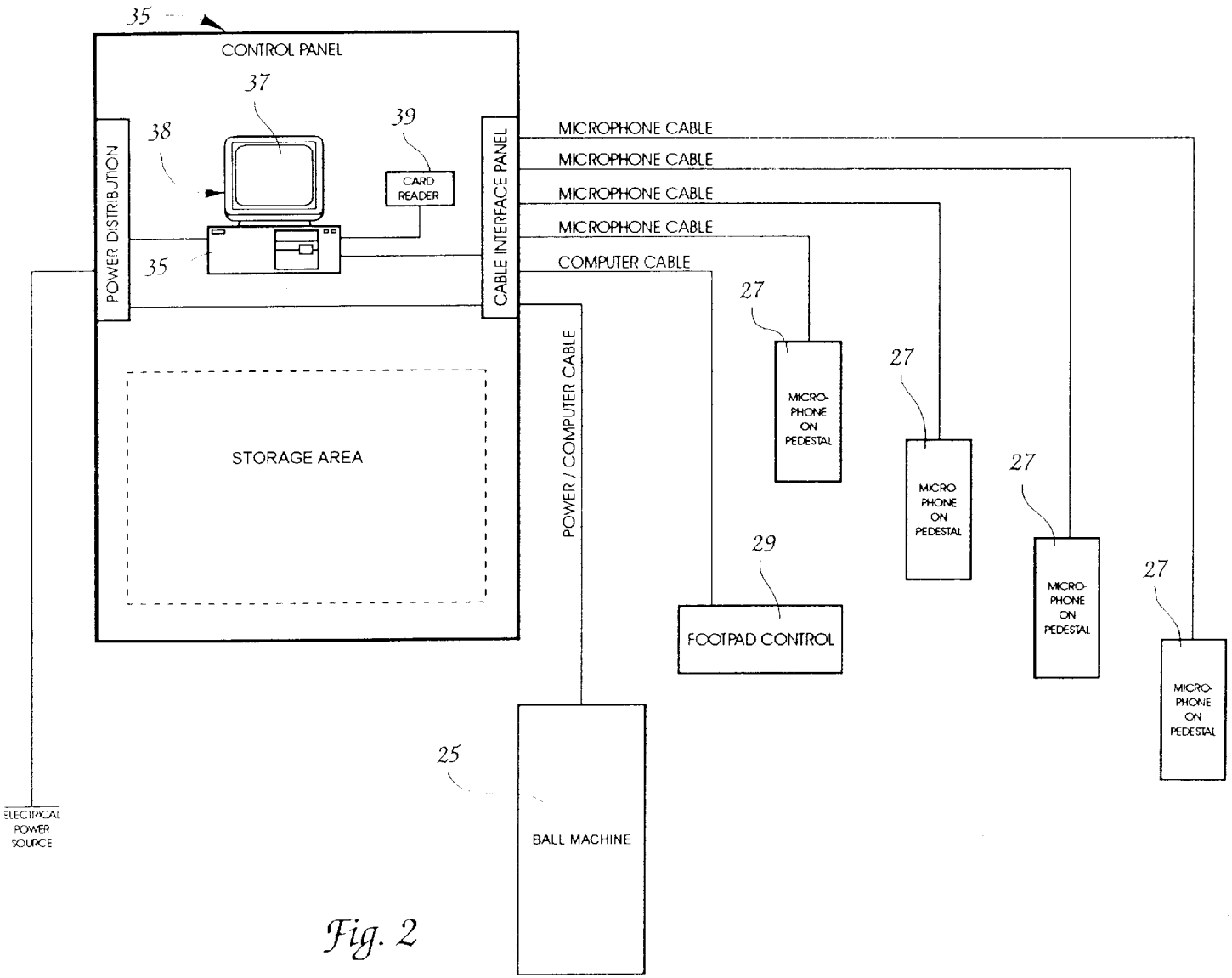
FIG. 2 is a schematic diagram of the control and sensing elements of the device of FIG. 1.

FIG. 2 illustrates in a schematic diagram the interactive tennis practice device of the present invention. Computer 33 in control panel 35 is electrically connected to microphones 27 and footpad control 29 to receive signals from these components, and is also electrically connected to ball machine 25 so that it can control the ball machine. The computer 33 is preferably an IBM compatible with a 486DX2/66 MHZ processor, and has a modem (not shown) to allow new drills and other information to be remotely transmitted to the computer 33. Computer 33 has a conventional touch screen color monitor 38, which allows a player to control the device by selecting options displayed on touch screen 37 of monitor 38. Card reader 39 is a conventional device which reads cards marked with bar codes which are issued to players who wish to utilize the interactive practice device.

Microphones 27 sense sound waves produced by the impact of tennis balls on tennis court 21, and transmit information regarding the sound waves to computer 33. Computer 33 compares the arrival time of information from the four microphones 27, and calculates the location of the ball impact through a process of triangulation. Sensors (not shown) may also be positioned so as to detect the impact of balls on net 23 in like manner. Microphones 27 contain specially designed circuit boards for filtering out frequencies which interfere with sensing of the location of ball impacts, the details of which are not part of the present invention. Microphones 27 are also preferably elevated above court 21 on pedestals in order to more effectively receive sound waves that may be carried up by heat rising from the surface of court 21.

Figure 3:
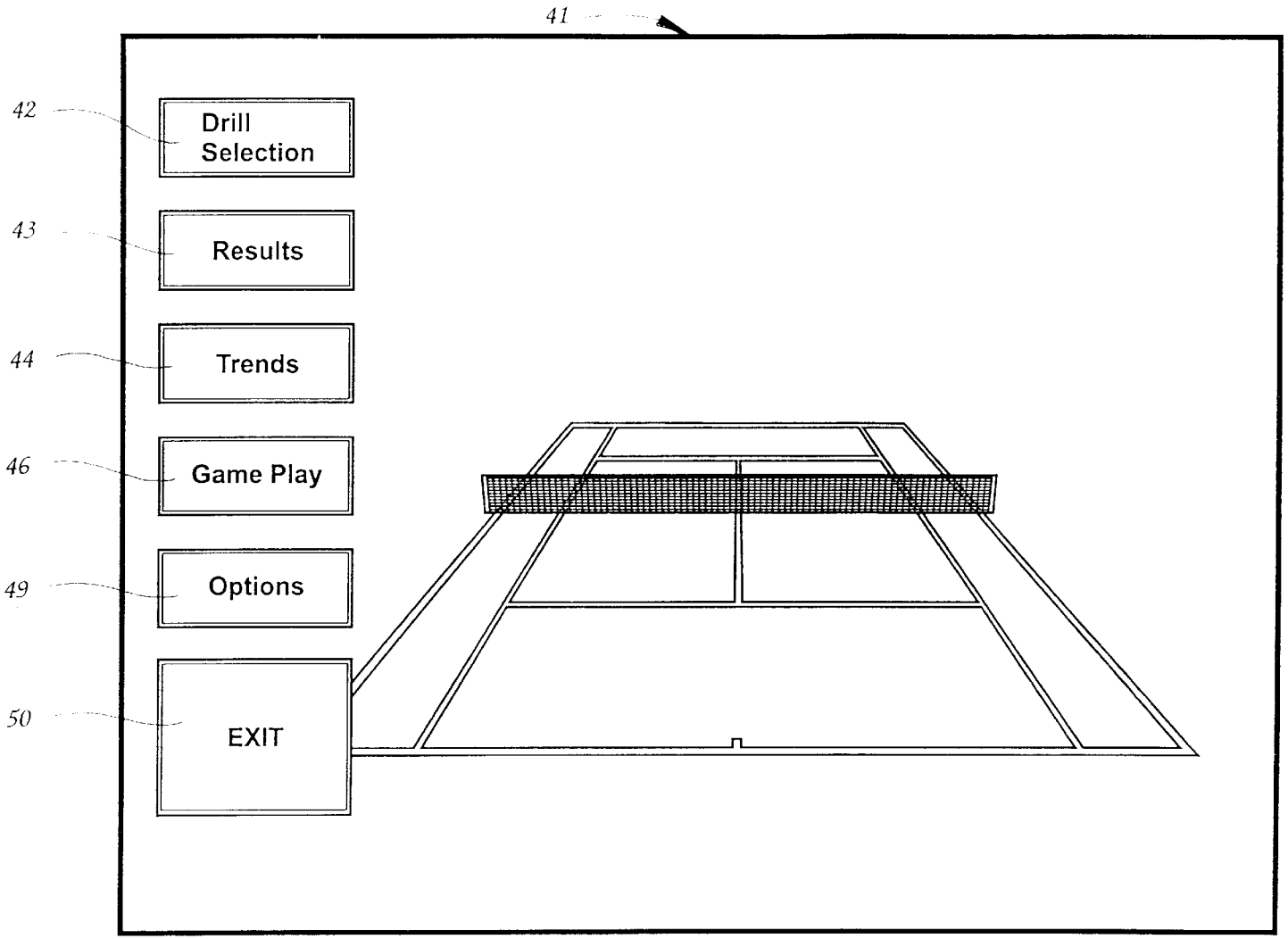
FIG. 3 is a representation of a computer graphic produced by the device of FIG. 1 on a monitor which permits a player to select how he or she wishes to utilize the device.

FIG. 3 illustrates main menu computer graphic 41 displayed on screen 37 to allow a player to select drills or other options for the device. A player selects his or her choices by touching one of the fields displayed on screen 37, such as "drill selection" field 42, which allows a player to select among various drills focusing on different strokes; "results" field 43, which allows a player to view the results of a particular practice session; "trends" field 44, which allows a player to view an analysis of his or her performance in a number of practice sessions over time; "game play" field 47, which allows a player to select a realistic and instructional simulation of game play, as will be described in more detail below; "options" field 49, which allows a player to control the audible feedback features of the invention, which will also be described in more detail; and "exit" field 50, through which a player can conclude a practice session.

Figure 4:
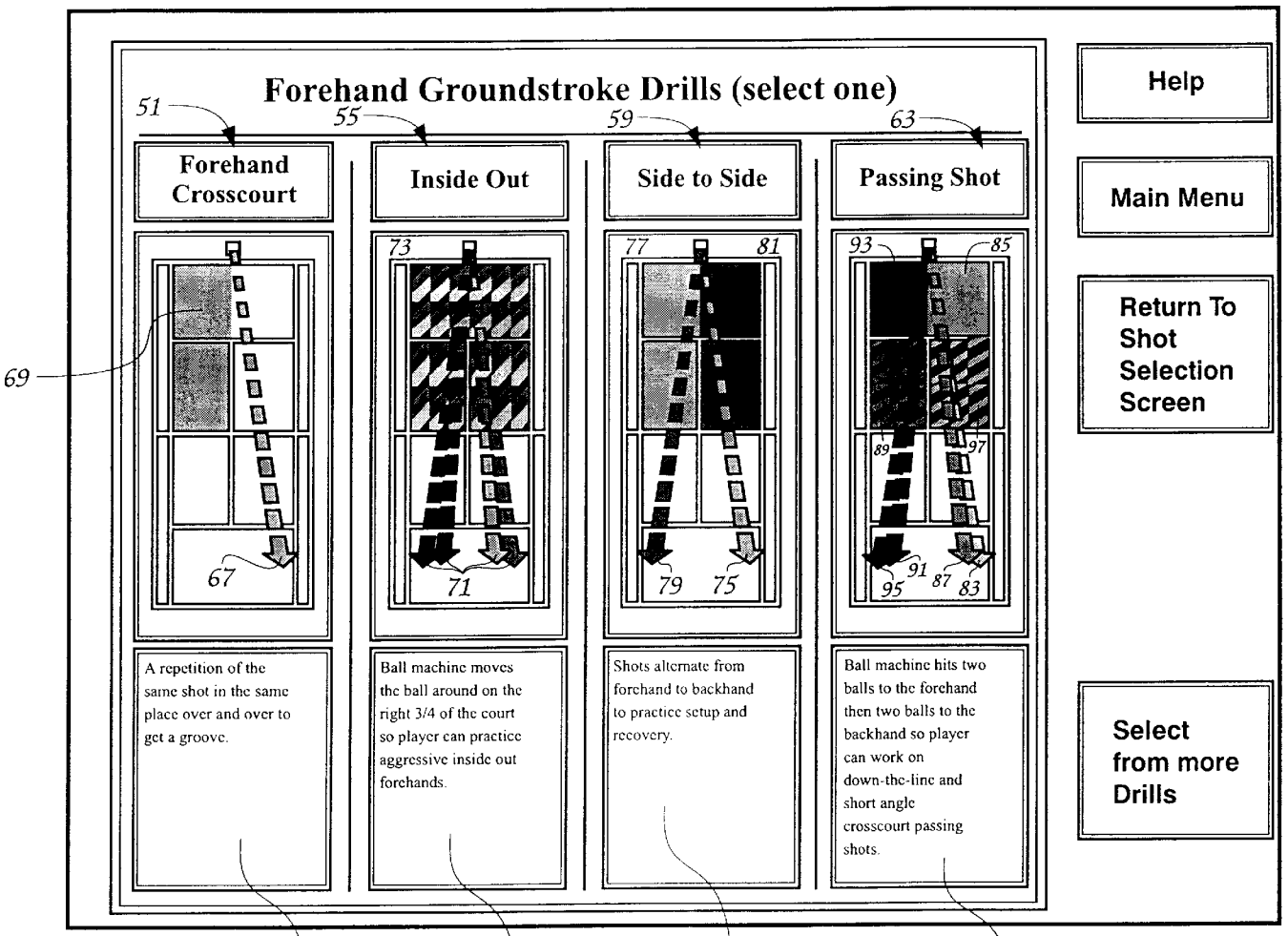
FIG. 4 is a representation of a computer graphic produced by the device of FIG. 1 on a monitor which permits a player to select one of several predetermined practice drills.

FIG. 4 illustrates drill choice computer graphic 45 displaying a typical choice of drills which can be selected by a player using the device. The four choices all involve drills directed to practicing forehand ground strokes, and a player can select the drill most appropriate for him or her. The practice drills of the interactive practice device and method involve a sequence of shots projected by ball machine 25 and to be hit by a player, and drill choice graphic 45 illustrates for the player how the particular sequence of shots in each drill will be played out. Forehand crosscourt drill 51 involves, as explained in text box 53 of graphic 45, a repetition of the same forehand cross court shot in the same place over and over. Inside out drill 55 is described in text box 57, side to side drill 59 is explained in text box 61, and passing shot drill 63 is explained in text box 65. Drill choice graphic 45 also includes, for each drill illustrated, arrows and target areas which show a player how the drill is to be conducted. The arrows and target areas are color-coordinated, so that a player can readily recognize the target area for a particular shot. In the Figures for the present invention, this color-coordination is depicted by using the same gray-scale fill for the arrows and targets which would be represented in the same color on screen 37 of color monitor 38.

For example, in forehand crosscourt drill 51, arrow 67 depicts the path of the ball projected by ball machine 25, while target area 69 indicates that the player should hit a shot which lands in the deuce court side of tennis court 21. For inside out drill 55, the player should hit all balls projected by ball machine 25, represented by arrows 71, anywhere within the limit of the singles court, as shown by target area 73, which is hatched in all four shades of arrows 71. For side to side drill 59, shots will alternate between a forehand (from a righthander's perspective) shown by arrow 75, which should be hit into target area 77, and a backhand shown by arrow 79, which should be hit into target area 81. In passing shot drill 63, the drill begins with a forehand shown by arrow 83, which is to be hit down the line into the add court side, as shown by target area 85. The next shot is also a forehand, shown by arrow 87, but this shot is to be hit into the crosscourt service box as shown by target area 89. The next shot, shown by arrow 91, is a backhand to be hit down the line on the deuce court side, as shown by target area 93, while the final shot in the sequence is shown by arrow 95, and is to be hit crosscourt into target area 97 in the add court service box.

Once a particular drill has been selected the player may chose a skill level through the skill level graphic (not shown), which allows the player to make the selected drill either more difficult or easier, to thereby suit the particular ability level of the player. As a player improves, he or she may adjust the skill level to keep the drill challenging and to continue improvement.

Also, if desired, this screen may permit the player to select the number of shots to be delivered by the ball machine in a particular drill and/or select the number of such shots delivered before there is a rest break as well as the duration of such rest break.

Figure 5:
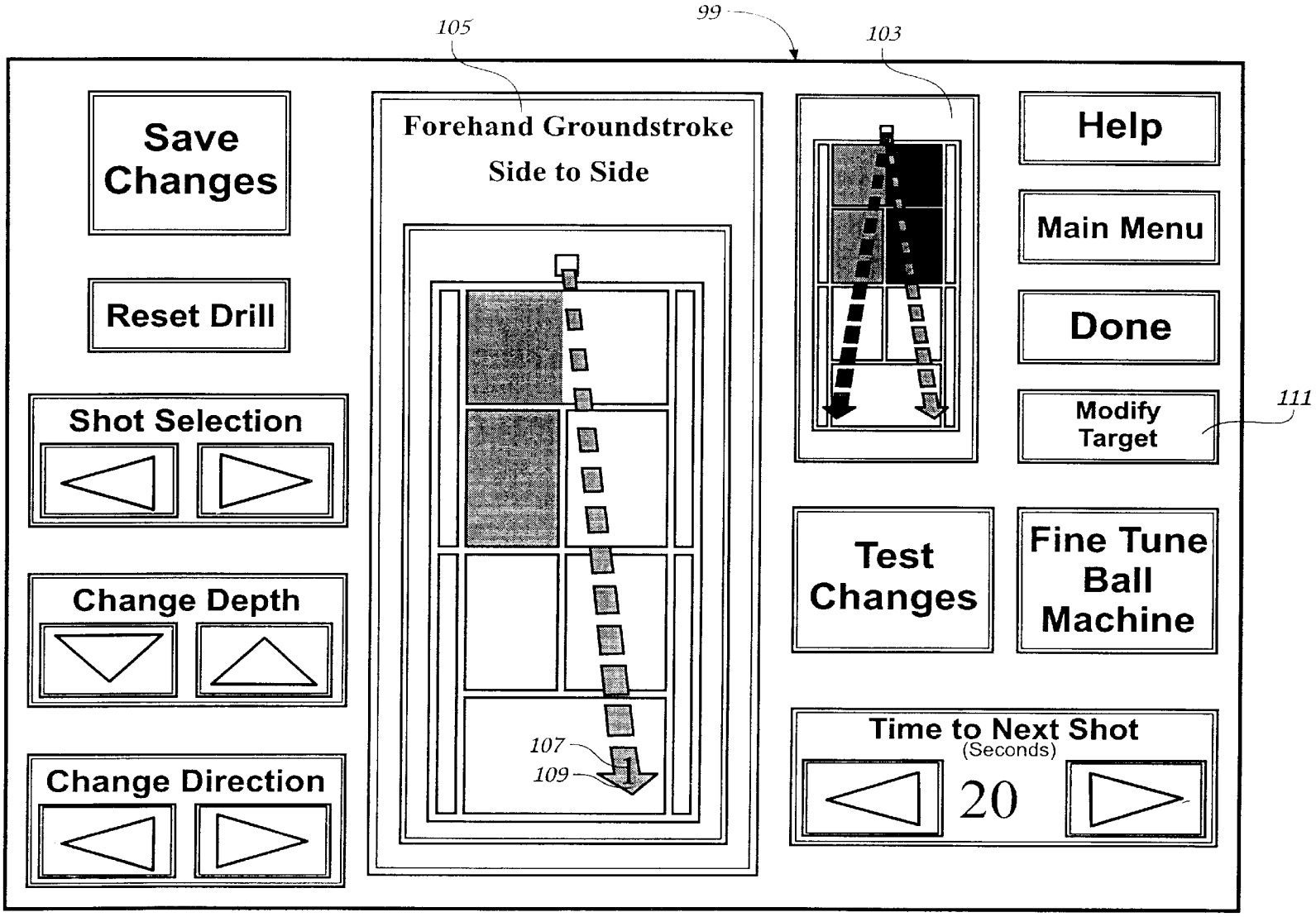
FIGS. 5 and 6 are representations of computer graphics produced by the device of FIG. 1 on a monitor which permit a player to set the characteristics of the shots projected by the ball machine of the device.
Figure 6:
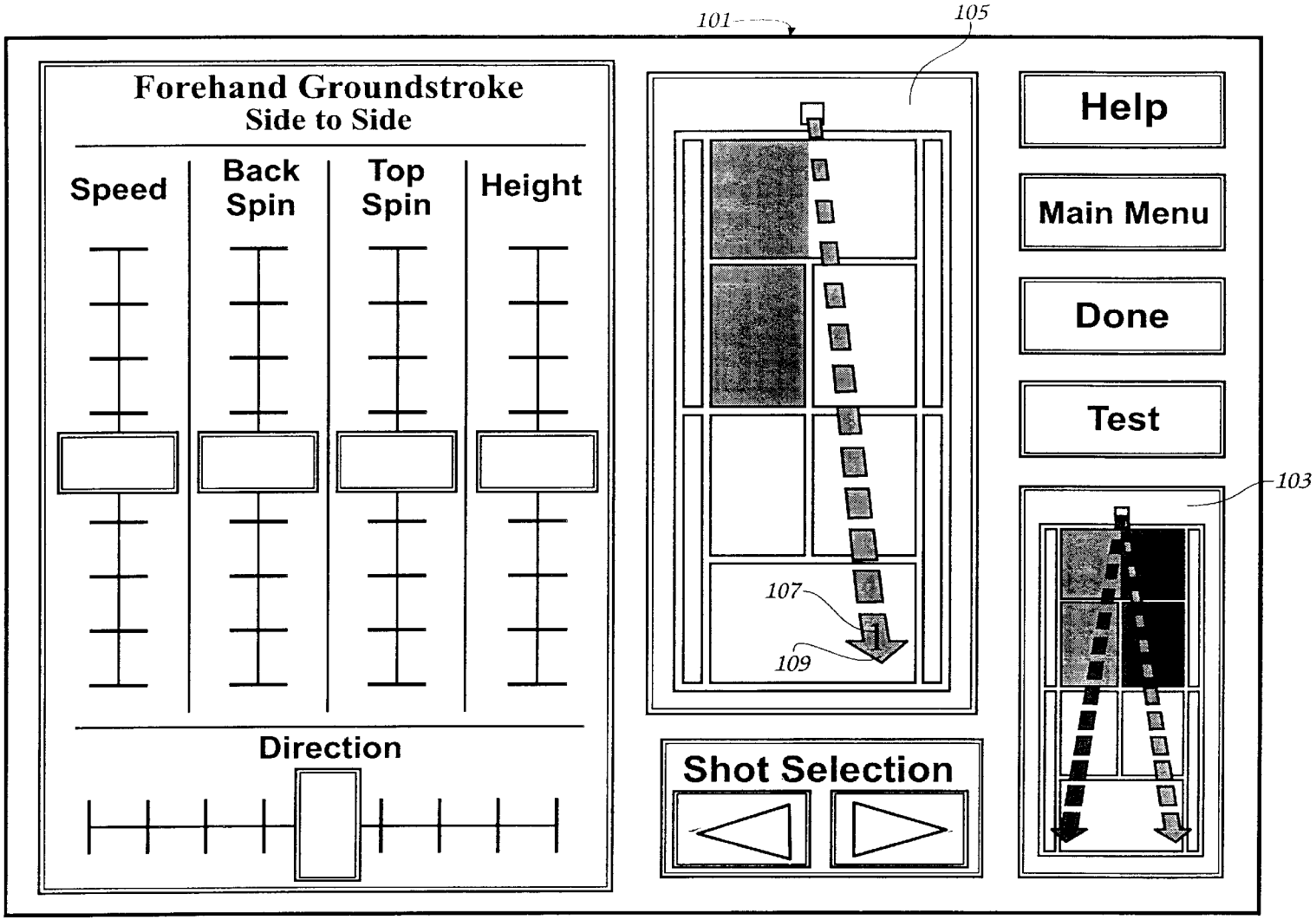

FIGS. 5 and 6 illustrate modification computer graphic 99 and fine tune graphic 101, respectively, displayed on screen 37 to allow a player to modify the characteristics of shots projected by ball machine. By making selections on modification graphic 99 and fine tube graphic 101, a player can alter the velocity, trajectory, and direction, as well as other characteristics, of shots projected by ball machine 25. As seen in FIG. 4 and previously explained herein, the practice drills of the present invention involve a sequence of shots, and modification computer graphic 99 and fine tune computer graphic 101 allow each shot within that sequence to be modified. In both modification graphic 99 and fine tune graphic 101, drill field 103, in which a small representation of a tennis court appears, shows all the shots to be made during the drill being modified, in this case, the forehand ground stroke side-to-side drill, which is also shown as side-to-side drill 59 in FIG. 4. The larger shot field 105, which also includes a representation of a tennis court, shows the particular shot in the drill sequence which is to be modified, while sequence number 107 (here "1") in arrow head 109 indicates to the player the numerical sequence within the drill of the shot to be modified. Modify target field 111 allows a player to go to target computer graphic 113, shown in FIG. 7, to modify the target area for the drill shot, as will be described in greater detail below.

It will be understood that all of the drawings relating to particular drills and choices, such as FIG. 4 and similar drawings to be described presently, are merely illustrative of a wide variety of drills and choices that can be utilized by the present invention. For example, while FIG. 4 illustrates drills relating to forehand ground strokes, the present invention can provide similar computer screen graphics for forehand volleys, backhand volleys, and backhand ground strokes, etc.

Figure 7:
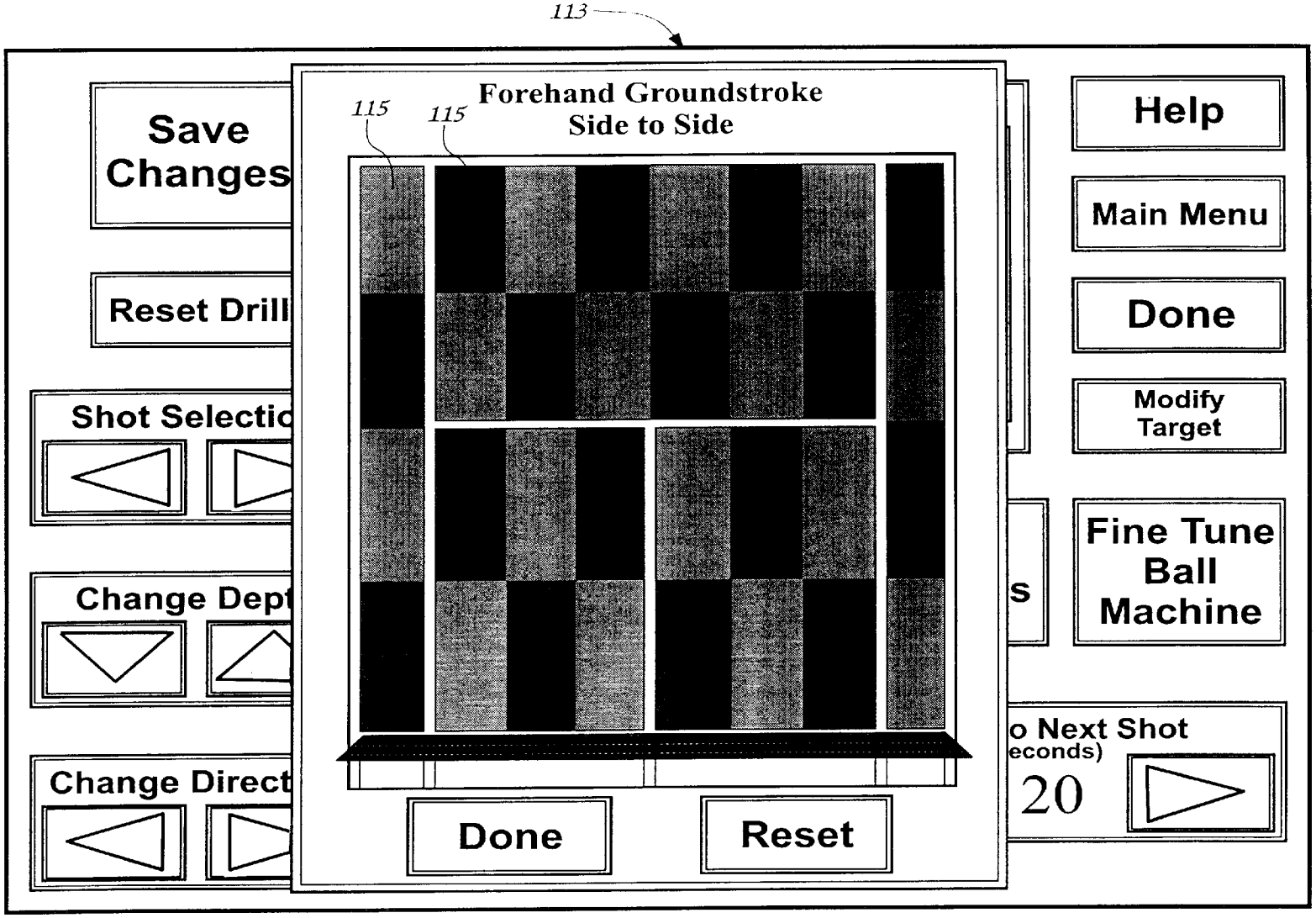
FIG. 7 is a representation of a computer graphic produced by the device of FIG. 1 on a monitor which permits a player to select one of several predetermined target areas on the tennis court.

FIG. 7 illustrates target computer graphic 113 which permits a player to select a particular target area to which he or she wishes to direct shots. In FIG. 7, all of the target areas 115 are shown in alternating light and dark shading merely to illustrate the number of target areas which can be selected, and it should be understood that a player would not select such a target area pattern. Target areas 115 can be selected individually or in combination to form a large target, such as the entire deuce court side, the add court service box, or many others, some of which are shown in FIG. 4 in drill choice graphic 45.

Figure 8:
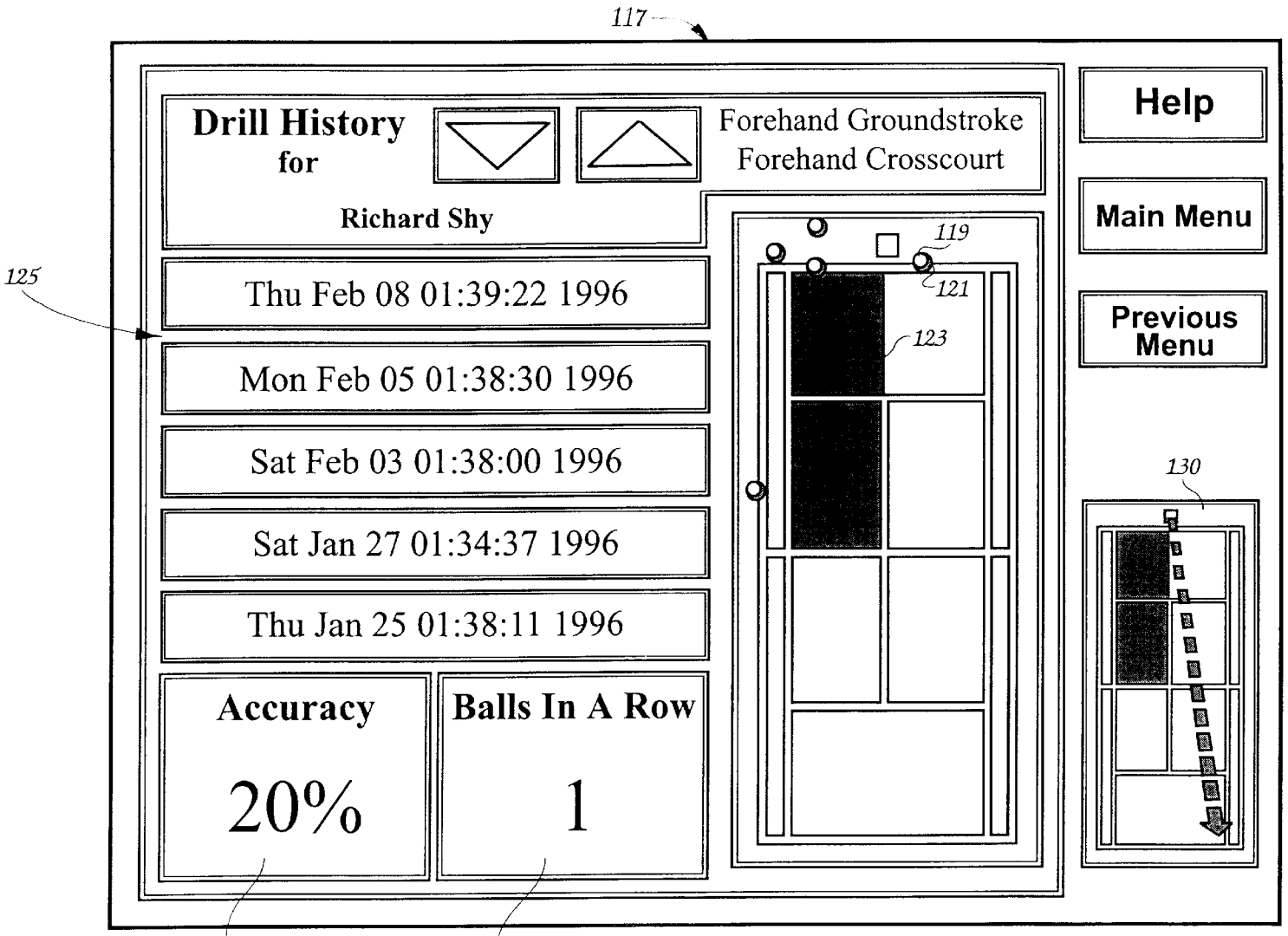
FIG. 8 is a representation of a computer graphic produced by the device of FIG. 1 on a monitor which displays the results of a player's practice session with the device.

In results computer graphic 117, shown in FIG. 8, computer screen 37 displays the selected target area along with the impact locations 119 of the shots struck by the player during the drill. Shot impact locations 119 have a crescent-shaped portion 121 which is displayed in a color which matches the color of selected target area 123, thereby indicating the intended target of the shot. This feature may be especially helpful in drills which include more than one target area in the sequence of shots making up the drill. A player can view results graphic 117 and readily assess the accuracy of his or her shots in the practice session shown and also select any of the last five sessions of any particular drill for review, as shown in previous sessions fields 125. Results graphic 117 also displays "balls in a row" field 127 showing the number of times the player hit the ball into the selected target area consecutively, and "accuracy" field 125, which displays the overall accuracy of the shots hit by the player in the drill session displayed. Drill field 130 uses the previously described arrow and target area format to illustrate the drill being reviewed, shown here as the forehand crosscourt drill.

Figure 9:
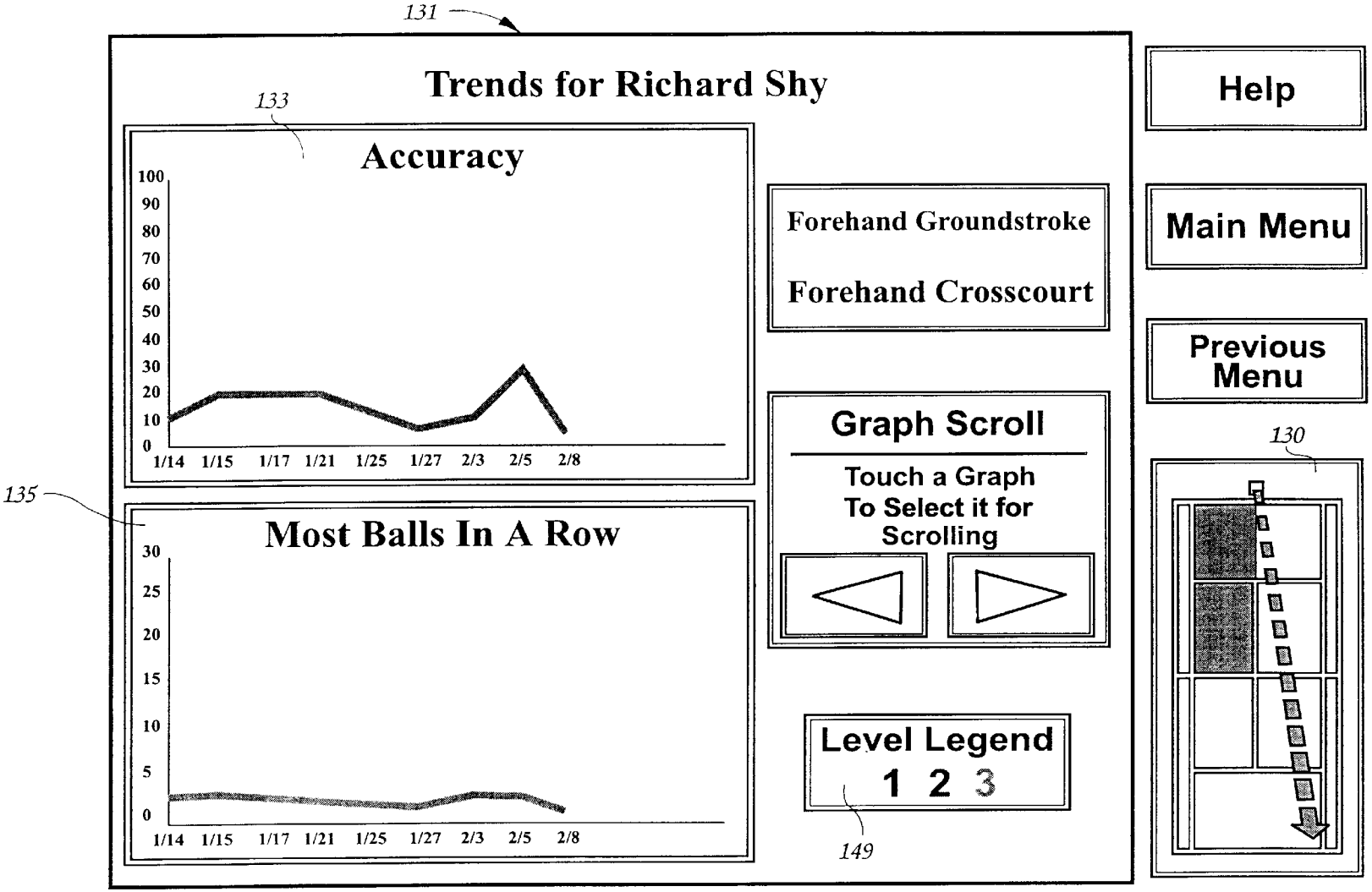
FIG. 9 is a representation of a computer graphic produced by the device of FIG. 1 on a monitor which displays the results and trends of a number of practice sessions of a player with the device.

Trends computer graphic 131 in FIG. 9 allows a player to review his or her performance for all the times that the player has done a particular drill. Trends graphic 131 includes "accuracy" graph 133 and "most balls in a row" graph 135, both of which assist a player in quickly evaluating performance in a specific drill over time. Drill field 130 illustrates the drill for which performance is shown, hereagain the forehand crosscourt drill.

Figure 10:
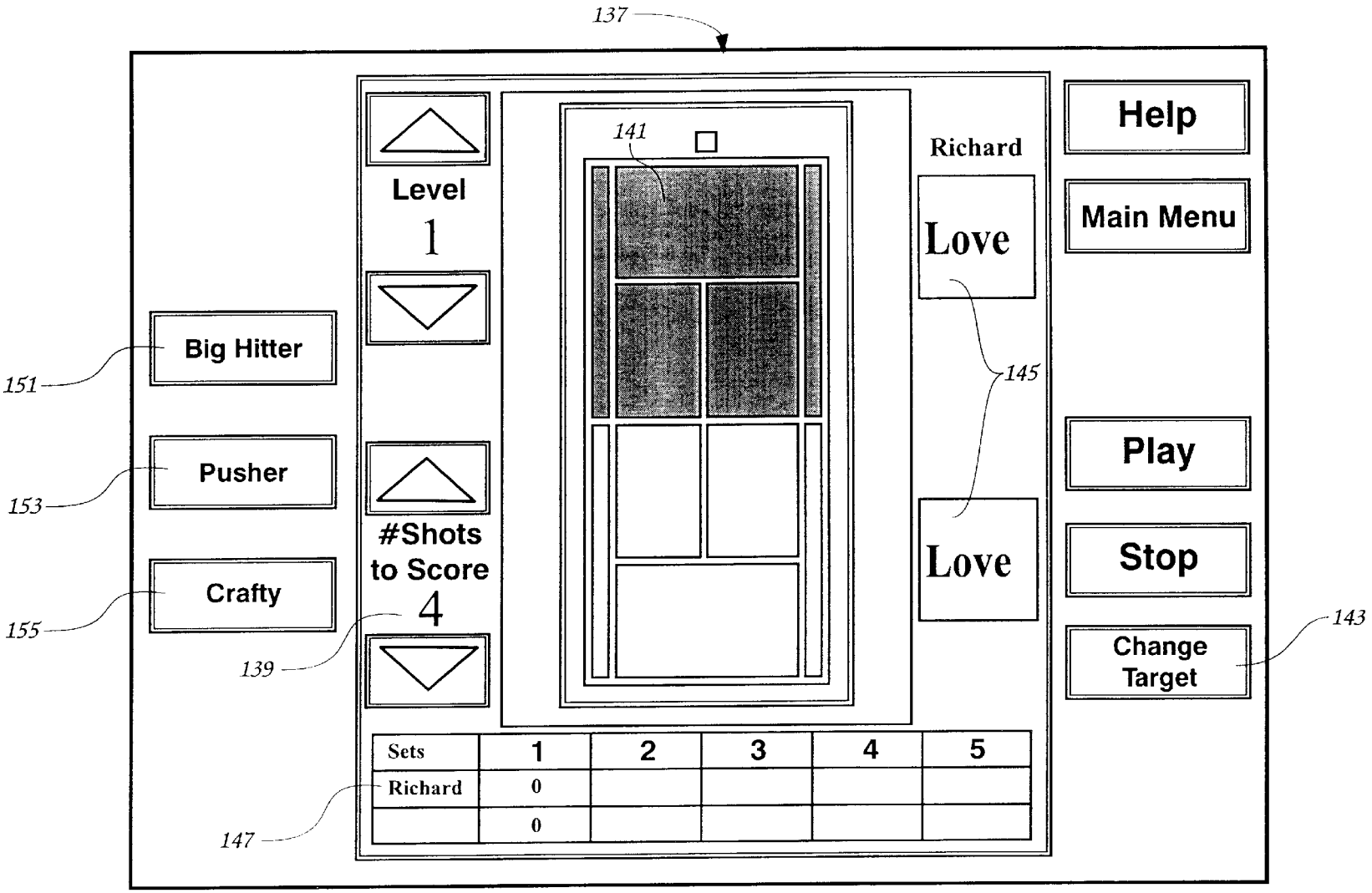
FIG. 10 is a representation of a computer graphic produced by the device of FIG. 1 on a monitor which permits a player to select a game play option and choose one of several shot profiles for the ball machine of the present device.

FIG. 10 illustrates game play computer graphic 137, through which a player can initiate a simulation of game play with the interactive practice device, as explained in greater detail below. "Shots to score" field 139 displays the number of shots which the player must hit within the target in order to score a point against the interactive practice device and also allows the player to modify the number of shots to score. Target area 141 indicates the target area selected by the player for the match, and "change target" field 143 allows the player to change the size of the target area. Game play graphic 137 also includes game score field 145, which indicates the game score between the interactive practice device and the player, and set score field 147, which shows the set score in the match.

In operation, a player will preferably use a conventional card marked with a bar code (not shown) to be inserted in card reader 39 for actuating the interactive practice device and identifying the player for purposes of recording the results of the practice session. In instances where the interactive tennis practice device is installed at a resort or sports club, such cards could be made available through the pro shop or other like facility. The player would first go to main menu graphic 41 to choose among the general types of practice there displayed in fields to be selected by touching screen 37 where the desired choice appears. If, for example, drill selection field 42 is touched on screen 37 of touch screen monitor 38, the player would then be able to select which strokes he or she wished to practice through a shot selection screen (not shown). Drill choice graphic 45 would appear if forehand ground strokes were selected as the stroke to be practiced, and this graphic illustrates some of the further choices of specific drills available to the player to practice this particular shot. Should the player wish to modify the drill, he or she can do so through modification graphic 99 and fine tune graphic 101, which allow the characteristics of the shots projected by the ball machine 25 to be modified extensively. Shot velocity, direction, trajectory, as well as other characteristics, can be modified thought these two graphics.

Once the player desires to commence the drill, he or she would go to the play drill computer graphic (not shown) and either start the drill from screen 37 or move to the player's side of the court and actuate foot paid 29. If the player's coach is present, the coach can control the interactive practice device from screen 37 while the player remains on the player's side of the court. Ball machine 25 then projects balls in the selected pattern, for example as shown in the drills depicted in drill selection graphic 45, and as modified if modification graphic 99 or fine tune graphic 101 have been utilized. As the player returns balls projected by ball machine 25, microphones 27 sense the sound of the impact of the balls on tennis court, and, as described above, transmit this information to computer 33, which determines the location of the shot impacts through the previously-mentioned triangulation process. The ball machine 25 is controlled to project another ball in timed response to the sensing of an impact, thereby linking the ball machine's actions to the player's shots and rhythm rather than at arbitrary intervals, which provides a responsive element making the practice session much closer to the experience of exchanging shots with another player.

Computer 33 records the impact locations of balls struck by the player and displays these locations as shown in results graphic 117, which allows the player to quickly and effectively review his or her performance in the practice session. As noted on results graphic 117 in previous sessions fields 125, data from previous drills by the same player is stored in the computer and may be recalled for a more comprehensive review of the player's progress and the effectiveness of the practice drills selected.

For a more comprehensive review of performance in a drill, a player may go to trends graphic 131 to see an analysis of all the times he or she has performed a particular drill. The interactive practice device produces "accuracy" graph 133, which charts the accuracy of the player in each session of the drill, and "most balls in a row" graph 135, which likewise charts the highest number of consecutive on-target hits by the player in each session. The plot lines in both of these graphs are color-coded to indicate the skill level at which the drill was set when performed, with level legend 149 indicating the colors for the three skill levels available.

The player may focus his or her practice efforts by selecting a target area for the player to endeavor to hit, as shown in target graphic 113. A wide number of predetermined target areas and combinations of target areas are available for selection by the player, so as to allow practice to be focused on practically any shot desirable for singles or doubles play. Selected target area 123 is displayed on results graphic 117 to provide the player with a precise record of his or her accuracy in hitting the target. The player may also choose to have the device produce a predetermined audible signal each time he or she hits the selected target, thereby providing immediate feedback during the practice session.

The interactive tennis practice device also detects and records the number of consecutive shots which hit the target, as shown in "balls in a row" field 127 on results graphic 117, and can generate an audible signal each time the player reaches a new high for consecutive hits. The device further detects and records when the player reaches a new high for consecutive hits successively, without an intervening miss, and can generate audible signals, for example the sounds of an enthusiastic audience, which increase in volume each time the player successively reaches a new high. Once a miss occurs after a new high has been reached, the device can produce the sound of an audience groaning to indicate the target was not hit.

The present invention also allows the player to choose game play by selecting game play field 47 on main menu graphic 41. In game play, the device projects a ball each time the player successfully hits a selected target area, and ball machine 25 is controlled to act in timed response to the player's shots, thereby providing a responsive exchange of shots to simulate actual game play. The target area can be modified through "change target" field 143 to select among an extensive choice of target options, as previously discussed and depicted in target graphic 113. The default target area which is in effect when no target selection has been made is the entire court, including doubles alleys, as shown by target area 141 in FIG. 10. The player can also set and modify how he or she "wins" a point against the interactive practice device, by designating in shorts to score field 139 the number of shots which must be hit into the target area to cause the device to temporarily cease projecting a sequence of balls.

During game play, ball machine 25 is controlled to serve a ball into the appropriate service court when the interactive practice device is "on serve." When the player is on serve, he or she serves into the appropriate service court to initiate the point, and if the serve is good, the interactive practice device responds with a return. When a point is over, either from the player winning the point or hitting the ball out of the target before achieving the required number of accurate shots to win the point, the interactive practice device waits a preset amount of time, and can either audibly call for the player to serve the ball and then await the player's serve, or announce that the player should get ready to receive a serve from the device and then project a serve.

The player may select a particular type of player profile which he or she wishes the interactive device to emulate during game play. The device has predetermined profiles which have preset characteristics controlling, for example, the velocity, trajectory, and direction of shots projected by the ball machine. If the player selects the "Big Hitter" field 151 on game play graphic 137, the device will deliver hard, fast, and low shots, whereas selection of the "Pusher" field 153 will result in deep, loopy shots being delivered. An additional profile is also available for selection, as represented in the "Crafty" field 155.

The device can keep score of the match during game play in game score filed 145 and set score 147, and can also audibly announce the score and audibly call service faults by the player. If the player feels that the device has incorrectly scored a point, he or she can press the replay pad on foot pad 29, which will erase the last point and cause the point to be played over.

The device and method of the present invention possesses a number of advantageous features which work together to significantly increase the effectiveness and enjoyment of practice sessions. A wide selection of drills are presented for a player's choice, with the drills being easily modifiable in a number of respects, and the locations of the shots hit by the player are recorded and displayed for review of current results and comparison with previous practice sessions. The ball machine is controlled to project balls in timed response to a player's shots, thereby providing a responsive exchange between the device and the player. The game play option offers a realistic and entertaining simulation of actual game play, incorporating the projection of balls in timed response to the player's own shots with target selection capability and the ability to select a profile of shot characteristics for the device.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An interactive tennis practice device, comprising:

a ball machine for projecting onto a first half of a tennis court tennis balls to be struck by a tennis player;

a control device for controlling said ball machine to project the tennis balls in one of a plurality of predetermined practice drill patterns selectable by the tennis player, each practice drill pattern including a sequence of drill shots with each drill shot having a predetermined ball velocity, predetermined ball trajectory, and predetermined ball direction;

means for sensing a point of impact of each tennis ball anywhere on a second half of the tennis court opposite the first half after being struck by the tennis player; and means for displaying on a video screen the location on the tennis court of the points of impact.

2. The interactive tennis practice device of claim 1, in which the tennis court includes a net, and said means for sensing includes means for detecting the points of impact of the tennis balls on the net and means for displaying on the video screen the location on the net of the impact points.

3. The interactive tennis practice device of claim 1, in which said means for sensing the impact points further includes means for recording the impact points and for retrieving the record of the impact points.

4. The interactive tennis practice device of claim 1, in which said control device includes means for modifying the predetermined ball velocity, predetermined ball trajectory, and predetermined ball direction of each drill shot in a practice drill pattern.

5. The interactive tennis practice device of claim 1, in which said sensing means includes target means for permitting the tennis player to select and display on the video screen one of a plurality of predetermined target areas within the confines of the second half of the tennis court.

6. The interactive tennis practice device of claim 5, in which said sensing means generates a signal upon sensing a point of impact of a tennis ball in the selected target area after being struck by the tennis player, and further comprising audible response means for receiving the signal and generating a predetermined audible signal in response thereto.

7. The interactive tennis practice device of claim 5, further comprising means for detecting and recording the number of the points of impact which occur consecutively within the selected target area, means for determining when the recorded number of consecutive impacts reaches a new high, and means for generating a predetermined audible signal each time the new high is reached by the tennis player.

8. The interactive tennis practice device of claim 7, in which said means for detecting and recording includes means for determining when the tennis player reaches the new high consecutively, and means for increasing the volume of the predetermined audible signal each time the new high is reached consecutively.

9. The interactive tennis practice device of claim 1, in which said control device includes means for receiving electronic communications including predetermined drill patterns for said control device from a remote location.

10. An interactive tennis practice device, comprising:

a ball machine for projecting onto a tennis court a plurality of tennis balls in series to be struck by a tennis player;

means for sensing the point of impact of each of the tennis balls on the tennis court after being struck by the tennis player and means for transmitting a signal each time one of the impact points is sensed; and a control device for receiving the signals and for controlling said ball machine to project another tennis ball toward the tennis player in timed response to the receipt of one of the signals each time one of the signals is received.

11. An interactive tennis practice device, comprising:

a ball machine for projecting onto a tennis court a plurality of tennis balls in series to be struck by a tennis player;

target means for permitting the tennis player to select one of a plurality of predetermined target areas within the confines of the tennis court;

means for sensing the initial impact of each of the tennis balls in the target areas after being struck by the tennis player and for transmitting a signal each time one of the impact points is sensed; and a control device for receiving the signals and for controlling said ball machine to project another tennis ball toward the tennis player in timed response to the receipt of one of the signals each time one of the signals is received.

12. The interactive tennis practice device of claim 11, in which said control means includes means for permitting the tennis player to select any of several predetermined shot profiles, each one of the profiles controlling said ball machine to project tennis balls with preset characteristics of velocity, trajectory and direction.

13. The interactive tennis practice device of claim 11, in which said sensing means includes means for permitting the tennis player to set a win-level by selecting a number of consecutive impacts within the target area which will win a point and for recording the number of points of impact which occur consecutively within the target area, said ball machine discontinuing the projection of tennis balls once said sensing means senses a consecutive number of points of impact within the target area equal to the win-level.

14. A method of interactively practicing tennis skills, comprising the steps of:

selecting one of a plurality of predetermined practice drill patterns, each practice drill pattern including a sequence of drill shots with each drill shot having a predetermined ball velocity, a predetermined ball trajectory, and a predetermined ball direction;

controlling a ball machine to project tennis balls onto a tennis court to be struck by a tennis player in said selected predetermined practice drill pattern;

sensing points of impact of the tennis balls anywhere on one-half of the tennis court after being struck by the tennis player; and displaying on a video screen the location on the tennis court of said sensed points of impact.

15. The method of claim 14, further including the step of designating one of a plurality of predetermined target areas within the confines of the one-half of the tennis court and displaying said designated target area on the video screen.

16. The method of claim 15, further including the steps of detecting whether points of impact are within said designated target area and generating a predetermined audible signal in response to points of impact being detected within said designated target area.

17. The method of claim 15, further including the steps of detecting whether the points of impact are within said designated target area and recording the number of points of impact which occur consecutively within said designated target area, and determining when the recorded number of consecutive impacts reaches a new high and generating a predetermined audible signal each time the new high is reached by the tennis player.

18. The method of claim 17, further including the step of increasing the volume of the predetermined audible signal each successive time the new high is reached by the player.

19. A method of interactively practicing tennis skills, comprising the steps of:

projecting onto a tennis court with a ball machine one of a plurality of tennis balls to be struck by a tennis player;

sensing the impact of the tennis ball on the tennis court after being struck by the tennis player and transmitting a signal when the impact is sensed;

receiving said transmitted signal and controlling a ball machine to project another tennis ball in timed response to the receipt of said transmitted signal; and repeating said steps of sensing, transmitting, receiving, and controlling each time one of the plurality of tennis balls impacts on the tennis court after being struck by the tennis player.

20. A method of interactively practicing tennis skills comprising the steps of:

selecting one of a plurality of predetermined target areas within the confines of a tennis court;

projecting onto a tennis court with a ball machine one of a plurality of tennis balls to be struck by a tennis player;

sensing the impact of the tennis ball in said selected target area after being struck by the tennis player and transmitting a signal when the impact is sensed;

receiving said transmitted signal and controlling a ball machine to project another tennis ball in timed response to the receipt of said transmitted signal; and repeating said steps of sensing, transmitting, receiving, and controlling each time one of the plurality of tennis balls impacts in said selected target area after being struck by the tennis player.

21. The method of claim 20, further comprising the steps of setting a win-level by selecting a number of consecutive impacts within said selected target area which will win a point, recording the number of impacts which occur consecutively within said selected target area, and discontinuing said projecting of tennis balls once the tennis player achieves a consecutive number of impacts in said selected target area equal to said selected win-level.

22. An interactive tennis practice device, comprising:

a ball machine for projecting onto a tennis court tennis balls to be struck by a tennis player;

means for sensing a point of impact of each tennis ball on the tennis court after being struck by the tennis player;

means for displaying on a video screen the location on the tennis court of the impact points; and means for recording the impact points and for later retrieving the record of the impact points.

23. An interactive tennis practice device, comprising:

a ball machine for projecting onto a tennis court tennis balls to be struck by a player;

means for sensing a point of impact of each tennis ball on the tennis court after being struck by the tennis player;

means for displaying on a video screen the location on the tennis court of the impact points; and means for permitting the tennis player to select and display on the video screen one of a plurality of predetermined target areas within the confines of the tennis court.

24. The interactive tennis practicing device of claim 23, in which said sensing means generates a signal upon sensing an impact of one of the tennis balls in a selected target area after being struck by the tennis player, and further comprising audible response means for receiving the signal and generating a predetermined audible signal in response thereto.

25. The interactive tennis practicing device of claim 23, further comprising means for detecting and recording the number of the impact points which occur consecutively within a selected target area, determining when the recorded number of consecutive impacts reaches a new high, and generating a predetermined audible signal each time the new high is reached by the tennis player.

26. The interactive tennis practicing device of claim 25, in which said means for detecting and recording includes means for determining when the tennis player reaches the new high consecutively and for increasing the volume of the predetermined audible signal each time the new high is reached consecutively.

27. An interactive tennis practice device, comprising:

a ball machine for projecting onto a tennis court tennis balls to be struck by a tennis player;

means for sensing a point of impact of the tennis balls on the tennis court after being struck by the tennis player;

means for displaying on a video screen the location on the tennis court of the impact points; and means for receiving electronic communications from a remote location including predetermined drill patterns for said control device.

28. A method of interactively practicing tennis skills, comprising the steps of:

selecting one of a plurality of predetermined practice drill patterns;

controlling a ball machine to project tennis balls onto a tennis court in said selected predetermined practice drill pattern to be struck by a tennis player;

sensing points of impact of each tennis ball after being struck by the tennis player;

displaying on a video screen the location on the tennis court of the impact points; and designating one of a plurality of predetermined target areas within the confines of the tennis court and displaying said designated target area on the video screen.

29. The method of claim 28, further including the steps of detecting whether the impact points are within a said designated target area and generating a predetermined audible signal in response to impact points being detected within said designated target area.

30. The method of claim 28, further including the steps of detecting whether the impact points are within a said designated target area and recording the number of the impact points which occur consecutively within said designated target area, and determining when the recorded number of consecutive impacts reaches a new high and generating a predetermined audible signal each time the new high is reached by the player.

31. The method of claim 30, including the step of increasing the volume of the predetermined audible signal each consecutive time the new high is reached by the tennis player.

* * * * *